United States Patent [19]

Atkins

[11] 3,987,857

[45] Oct. 26, 1976

[54] SIDE CUTTING DEVICE FOR EARTH BORING PROCEDURES

[75] Inventor: Stanley G. Atkins, Winnipeg, Canada

[73] Assignee: Armadillo Holdings Ltd., Winnipeg, Canada

[22] Filed: Apr. 18, 1975

[21] Appl. No.: 569,470

[52] U.S. Cl. ..... 175/53; 175/326; 175/414

[51] Int. Cl.[2] ..... E21C 23/00

[58] Field of Search ..... 175/53, 19, 62, 326, 175/416; 61/72.4, 72.7; 37/193

[56] References Cited

UNITED STATES PATENTS

| | | | |
|---|---|---|---|
| 2,305,200 | 12/1942 | Sitton | 175/326 X |
| 2,664,273 | 12/1953 | Merrick | 175/53 X |
| 2,903,252 | 9/1959 | Ebeling | 175/53 X |
| 3,478,527 | 11/1969 | Sherrod | 61/72.4 |
| 3,482,641 | 12/1969 | Atkins et al. | 175/53 X |
| 3,505,826 | 4/1970 | Hamstorf | 61/72.4 |
| 3,754,608 | 8/1973 | Baille et al. | 175/53 |

*Primary Examiner*—Ernest R. Purser
*Assistant Examiner*—Richard E. Favreau
*Attorney, Agent, or Firm*—Stanley G. Ade

[57] ABSTRACT

When a pilot hole is pushed through the soil from one location to another prior to pulling an earth cutter through the pilot hole, it is often found that the pilot hole has deviated from a straight line. This deviation is usually at the maximum at the exit end of the pilot hole. The present device is a substantially rectangular cutter assembly having a pipe connection allowing it to be attached on the end or along the length of the pilot hole forming pipe. The offstanding cutter portion not only cuts a plug of soil as it is pulled through the soil in one direction, but compresses this plug slightly. When the device is moved in the opposite direction, projections or the like engage this compressed plug and facilitate the extrusion of the plug through the exit end of the pilot hole. The device is secured either to the end of the pilot hole forming assembly or adjacent thereto, at the exit end and is turned so that it is offset in the direction opposite to the direction of the deviation. It is then pulled back by the pilot hole forming assembly thus cutting a substantially rectangular plug which is then extruded back through the exit end. This action is repeated until the pilot hole is aligned.

13 Claims, 5 Drawing Figures

SIDE CUTTING DEVICE FOR EARTH BORING PROCEDURES

BACKGROUND OF THE INVENTION

This invention relates to new and useful improvements in the formation of pilot holes used in earth boring procedures and an example of a pilot hole assembly is shown in U.S. Pat. No. 3,482,641.

When forming a pilot hole from one pit to another, the pilot hole often deviates from a straight line and this deviation is normally at a maximum at the exit end of the pilot hole.

Normally it is quite difficult to straighten up this pilot hole prior to moving the main earth cutter therethrough and the present device facilitates this straightening operation.

SUMMARY OF THE INVENTION

The principal object and essence of the invention is to provide a device which may be detachably secured to a pilot hole or forming assembly after the pilot hole has been formed and which then may be moved backwardly and forwardly through the portion of the pilot hole that deviates from a straight line, so that the pilot hole is gradually enlarged to the extent that a portion thereof is in alignment with the main portion of the pilot hole which is straight or in alignment.

Another object of the invention is to provide a device of the character herewithin described which can be turned so that it extends on the side of the pilot hole forming pipe opposite to the direction of deviation, whereupon it can be actuated to remove one or more plugs of soil on that particular side.

Another object of the invention is to provide a device of the character herewithin described which compresses slightly the plug of soil being cut by the device and which then extrudes the plug when the device is moved in the opposite direction.

Still another object of the invention is to provide a device of the character herewithin described which is simple in construction, economical in manufacture and otherwise well suited to the purpose for which it is designed.

With the foregoing objects in view, and other such objects and advantages as will become apparent to those skilled in the art to which this invention relates as this specification proceeds, my invention consists essentially in the arrangement and construction of parts all as hereinafter more particularly described, reference being had to the accompanying drawings in which:

BRIEF DESCRIPTION OF THE DRAWINGS

In the drawings like characters of reference indicate corresponding parts in the different figures.

DETAILED DESCRIPTION

Figure 5:
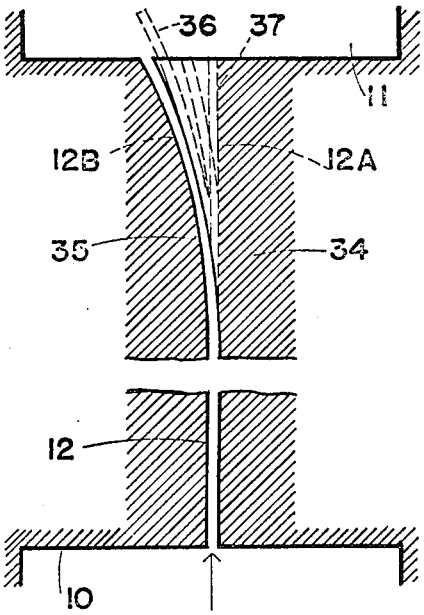
FIG. 5 is a schematic cross sectional view showing how a misaligned pilot hole may be straightened.

Proceeding therefore to describe the invention in detail, the pilot hole forming assembly conventionally used consists of a length of pipe having a forming head on one end thereof which is pushed through the soil from one location to another, usually from a pit such as is shown schematically at 10 towards a further pit such as is shown schematically at 11 in FIG. 5. This forms a pilot hole indicated by reference character 12 whereupon the cutter assembly (not illustrated) can be moved through the pilot hole to enlarge same.

Figure 2:
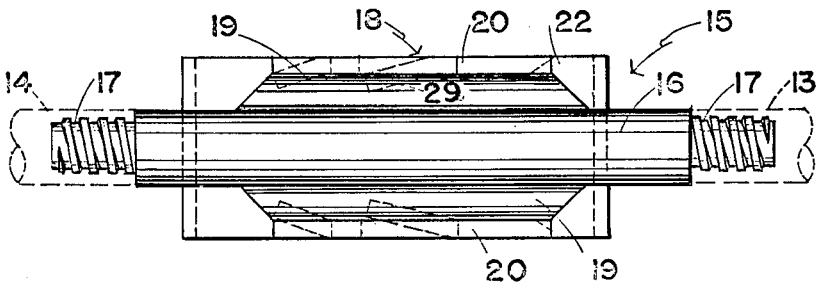
FIG. 2 is a side elevation of FIG. 1.

The pipe assembly used to form the pilot holes is cylindrical and one end of one length of pipe is shown in phantom by reference character 13 with one end of a further length of pipe being shown in phantom by reference character 14 in FIG. 2. These ends are internally screw threaded and are adapted to receive the various cutter assemblies which, of course, are provided with externally screw-threaded ends to screw threadably engage within these ends of the pipe lengths 13 or 14.

The present device collectively designated 15 is also adapted to be screw threadably engaged between two lengths of pipe such as shown at 13 and 14.

The attaching portion 16 is a cylindrical longitudinally extending member having screw threaded portions 17 formed on each end thereof, said portions being reduced in diameter with respect to the cylindrical member 16 so that when they are screw threadably engaged within the ends of pipe sections 13 and 14, the smooth connection is made between the member 16 and the pipe portions as clearly shown in FIG. 2.

A cutter assembly collectively designated 18 is secured to the attaching portion 16 and includes a pair of spacer members 19 secured as by welding to the pipe 16 one upon each side thereof so that they are in opposition one with the other.

A pair of side plates 20 are provided, each side plate being substantially rectangular when viewed in plan. Each of these side plates 20 are secured by the inner edges 21 thereof, one to each of the spacer members 19 also by welding or the like, so that the side plates extend upon one side of the pipe 16 in spaced and parallel relationship one with the other.

A substantially rectangular cutter plate 22 spans the distal ends 23 of the side plates 20 and is secured thereto as by welding thus defining, with the side plates and the pipe 16 and spacers 19, a substantially hollow body.

Figure 3:
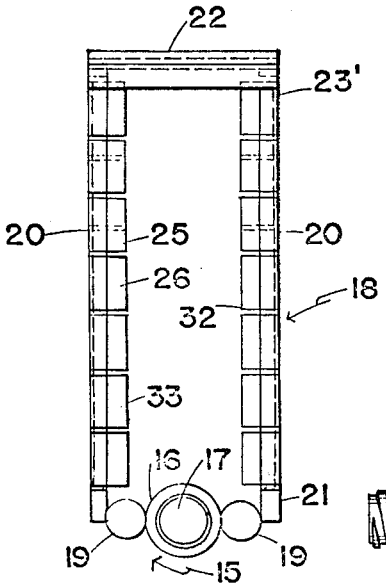
FIG. 3 is an end elevation of FIG. 1.
Figure 1:
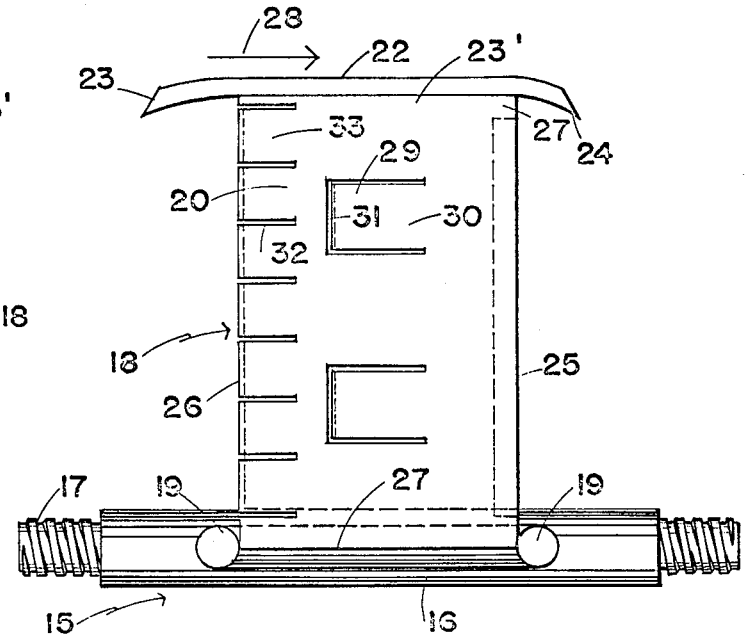
FIG. 1 is a plan view of the device per se.

This cutter plate is provided with end edges 23 and 24 which are situated beyond the boundaries of the side plates defined by the leading and trailing edges 25 and 26 respectively which lie normal to the longitudinal axis of the pipe 16 and the portions of the cutter plate 22 between the leading and trailing edges 25 and 26 and the edges 23 and 24 of the cutter plate, are curved inwardly towards the pipe 16 as clearly shown in FIG. 1 and both of the edges 23 and 24 of the cutter plate 22 are edge sharpened as clearly indicated.

Figure 4:
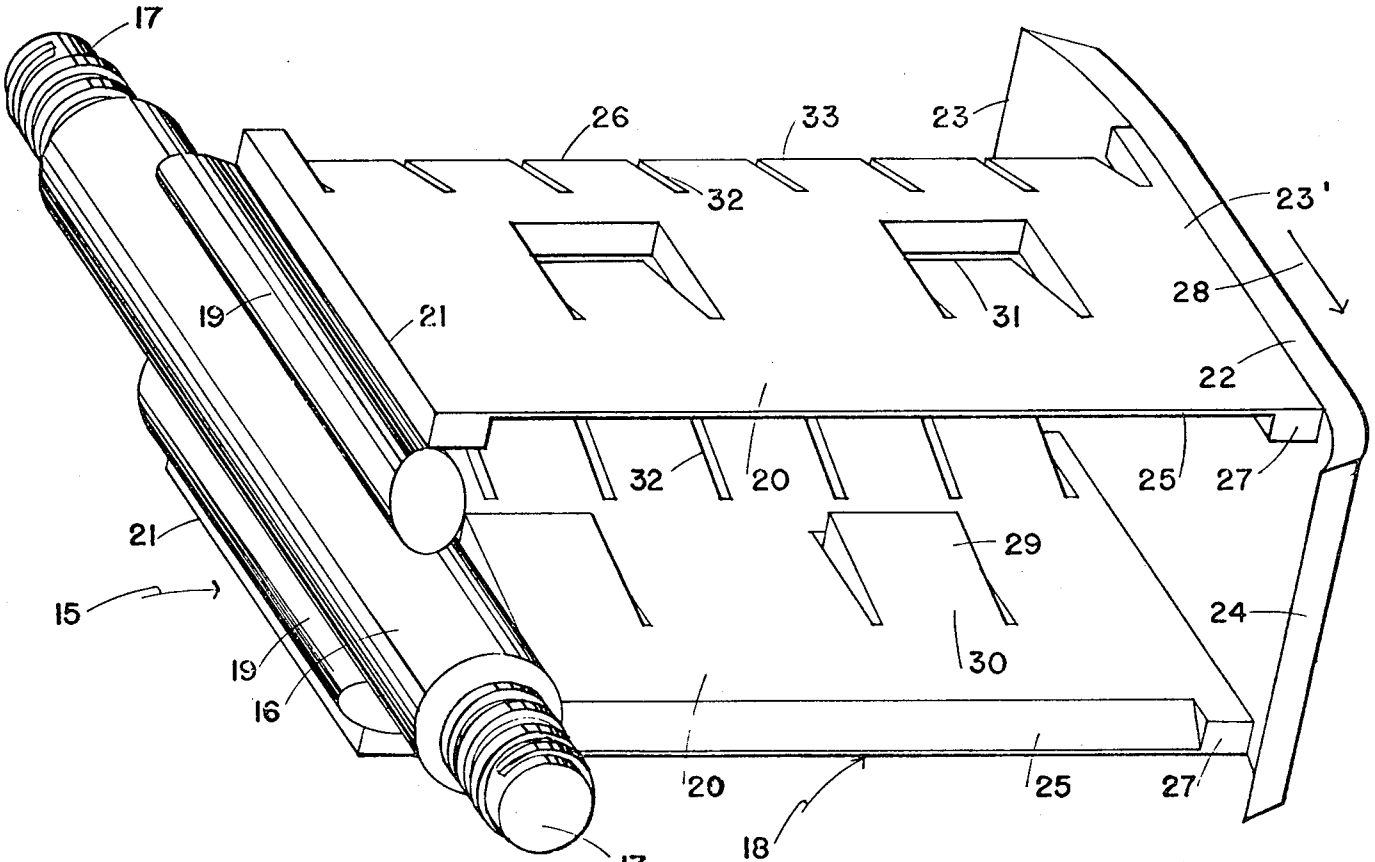
FIG. 4 is an isometric view of the device per se.

The leading edges of the side plates 20 are also edge sharpened as shown in FIG. 4 with the exception of the outer and inner ends of these edges 27 which are left at full thickness for reinforcing the attachment of the side plates to the spacers 19 and to the cutter plate 22 respectively.

Means are provided to compress the plug of soil when the device is moved in the direction of arrow 28, said means taking the form of tongues 29 struck or formed inwardly from the side plates, preferably in opposition one with the other as clearly indicated. These tongues incline inwardly from the ends 30 adjacent the leading edges 25 of the side plates, towards the ends 31 which are closest to the trailing edges 26 of the side plates.

Further compression of the plug of soil is provided by the portion of the side plates adjacent the leading edges 25 also being inclined inwardly towards one another and in this connection, a plurality of slots 32 is formed from the trailing edge 26, said slots lying in spaced and parallel relationship one with the other and parallel to the cutter plate 22. The portions 33 defined by these slots are inclined inwardly as clearly illustrated.

FIG. 5 shows schematically, a body of soil 34 through which it is desired to form a bore from location 10 to location 11. The pilot hole 12 is formed in the usual way and desirably the end of the pilot hole towards location 11 should follow the direction shown in phantom by reference character 12A. However, in this instance, the hole has deviated to the left with reference to FIG. 5 as shown in full line by reference character 12B and before pulling the main cutter through this pilot hole, it is obviously necessary to straighten the pilot hole or align the portion 12B with the portion 12.

With the pilot hole pipe (not illustrated) through the pilot hole, the head is detached and the present device 15 is screw threadably connected in alignment with the pilot hole forming pipe. The portion 18 of the device is then turned so that it extends towards the aligned position of the pilot hole or opposite to the direction of deviation. The device is then pulled back through the portion 12B so that the cutter plate 22 in conjunction with the side plates 20, cut a rectangular plug of soil and slightly compress same by the action of the tongues 29 and the trailing edges 33. It is pulled back until the point is reached identified approximately by reference character 35 whereupon it is reversed and moved in the direction opposite to arrow 28 so that the tongues 29 and the inturned edges 33 of the side plates assist in extruding this rectangular plug of soil. This is shown in phantom by reference character 36.

This action is repeated, moving the pilot hole pipe and the assembly 15 progressively closer to the straight line position of the pilot hole until all of this soil has been removed, with the cutter plate making the final cut substantially along the line indicated by reference character 37 in FIG. 5.

The device may then be removed and the main cutter assembly operated in the usual way.

The tongues 29 are of extreme importance in not only giving some initial compression to the plug, but in digging into the plug when extruding same and the trailing edges 26 together with the tongues 33 not only compress the plug in conjunction with the inturned end 23 of the cutter plate, but also slightly striate the upper and lower surfaces of the plug which assist in the separation thereof when extruding same.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What I claim as my invention is:

1. In a pilot hole boring assembly which includes a pilot hole forming pipe pushed through soil from one location to another location; a device for correcting deviation from a straight line of the hole formed by said boring assembly, said device comprising in combination an attaching portion adapted to be secured to said forming pipe in alignment therewith, means to secure said attaching portion to said forming pipe, and a cutter assembly extending from one side of said attaching portion, said cutter assembly including a hollow body and a cutter plate on the outer side of said hollow body, said cutter plate having a sharpened leading edge, and means on said hollow body to compress a plug of soil cut thereby when said device is moved through the soil in one direction and to facilitate extrusion of said plug of soil when said device is moved through the soil in the opposite direction, said hollow body including a pair of side plates secured by one end thereof one upon each side of said attaching portion and extending upon one side of said attaching portion in substantially spaced and parallel relationship one with the other, said cutter plate spanning the distal edges of said side plates, and being secured thereto, said attaching means, said cutter plate and side plates defining said hollow body, said plug of soil being cut by engagement of the leading edge of said cutter plate and part of the leading edges of said pair of side plates, with the wall of the hole formed by said boring assembly.

2. The device according to claim 1 in which said attaching portion comprises a longitudinally extending cylindrical member, externally screw threaded on each end thereof for detachable securement to said forming pipe.

3. The device according to claim 1 in which said cutter plate is substantially rectangular when viewed in plan and includes a pair of spaced and parallel longitudinal edges by which it is secured to said distal ends of said side plates, and a pair of end edges, said end edges extending beyond the edges of said side plates lying normal to said attaching means, the portion of said cutter plate between said end edges and the edge of said side plates lying normal to said attaching means, being arcuately curved towards said attaching means, both of said end edges being edge-sharpened.

4. The device according to claim 3 in which said means to compress a plug of soil cut thereby includes at least one tongue portion extending inwardly of each of said side plates in opposition one with the other, the distance between said tongue portions on one side plate relative to said tongue portions on the other of said side plates decreasing from the side of said tongue portions closest to said leading edge of said cutter plate towards the inwardly projecting sides of said tongue portions remote from said leading edges of said cutter portion.

5. The device according to claim 4 in which said means to compress a plug of soil cut thereby includes the portion of said side plates adjacent to the said edges of said side plates remote from said leading edge of said cutter plate, being inclined inwardly towards one other.

6. The device according to claim 5 which includes slots formed in said portions of said side plates adjacent to the said edges of said side plates remote from said leading edges of said cutter plate, said slots lying in spaced and parallel relationship one with the other and parallel to said cutter plate thereby defining a plurality of tongues extending inwardly of said side plates towards one another.

7. The device according to claim 3 in which said means to compress a plug of soil cut thereby includes the portion of said side plates adjacent to the said edges of said side plates remote from said leading edge of said cutter plate, being inclined inwardly towards one another.

8. The device according to claim 7 which includes slots formed in said portions of said side plates adjacent to the said edges of said side plates remote from said leading edges of said cutter plate, said slots lying in spaced and parallel relationship one with the other and parallel to said cutter plate thereby defining a plurality of tongues extending inwardly of said side plates towards one another.

9. The device according to claim 1 in which said means to compress a plug of soil cut thereby includes at least one tongue portion extending inwardly of each of said side plates in opposition one with the other, the distance between said tongue portions on one side plate relative to said tongue portions on the other of said side plates decreasing from the side of said tongue portions closest to said leading edge of said cutter plate towards the inwardly projecting sides of said tongue portions remote from said leading edges of said cutter portion.

10. The device according to claim 9 in which said means to compress a plug of soil cut thereby includes the portion of said side plates adjacent to the said edges of said side plates remote from said leading edge of said cutter plate, being inclined inwardly towards one another.

11. The device according to claim 10 which includes slots formed in said portions of said side plates adjacent to the said edges of said side plates remote from said leading edges of said cutter plate, said slots lying in spaced and parallel relationship one with the other and parallel to said cutter plate thereby defining a plurality of tongues extending inwardly of said side plates towards one another.

12. The device according to claim 1 in which said means to compress a plug of soil cut thereby includes the portion of said side plates adjacent to the said edges of said side plates remote from said leading edge of said cutter plate, being inclined inwardly towards one another.

13. The device according to claim 12 which includes slots formed in said portions of said side plates adjacent to the said edges of said side plates remote from said leading edges of said cutter plate, said slots lying in spaced and parallel relationship one with the other and parallel to said cutter plate thereby defining a plurality of tongues extending inwardly of said side plates towards one another.

* * * * *